US008480208B2

(12) United States Patent
Takemoto et al.

(10) Patent No.: US 8,480,208 B2
(45) Date of Patent: Jul. 9, 2013

(54) LIQUID-DROPLET EJECTION HEAD AND LIQUID-DROPLET EJECTION APPARATUS INCLUDING SAME

(75) Inventors: Takeshi Takemoto, Kanagawa-ken (JP); Yukitoshi Tajima, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 375 days.

(21) Appl. No.: 12/951,189

(22) Filed: Nov. 22, 2010

(65) Prior Publication Data

US 2011/0122199 A1 May 26, 2011

(30) Foreign Application Priority Data

Nov. 25, 2009 (JP) ..... 2009-267304

(51) Int. Cl.
*B41J 2/14* (2006.01)

(52) U.S. Cl.
USPC ..... 347/48; 347/50

(58) Field of Classification Search
USPC ..... 347/48, 50
See application file for complete search history.

(56) References Cited

U.S. PATENT DOCUMENTS

| | | | | |
|---|---|---|---|---|
| 6,367,914 | B1 | 4/2002 | Ohtaka et al. | |
| 6,705,716 | B2 * | 3/2004 | Mott | 347/94 |
| 2012/0069102 | A1 * | 3/2012 | Takemoto | 347/70 |

FOREIGN PATENT DOCUMENTS

| | | |
|---|---|---|
| JP | 2001-113700 | 4/2001 |
| JP | 2004-82650 | 3/2004 |
| JP | 3580363 | 7/2004 |
| JP | 2005-349712 | 12/2005 |
| JP | 3988042 | 7/2007 |

* cited by examiner

*Primary Examiner* — Kevin S Wood
(74) *Attorney, Agent, or Firm* — Cooper & Dunham LLP

(57) ABSTRACT

A liquid-droplet ejection head includes a nozzle substrate, a chamber substrate, a liquid supply substrate, a frame substrate, a driving circuit member, and wire members. The nozzle substrate includes nozzles. The chamber substrate is formed on the nozzle substrate and includes liquid chambers, diaphragms, and electro-mechanical transducers. The liquid supply substrate is formed on the chamber substrate and includes liquid supply channels. The frame substrate is formed on a first face of the liquid supply substrate opposite a second face of the liquid supply substrate formed on the chamber substrate. The driving circuit member that drives the electro-mechanical transducers is mounted on the frame substrate. The wire members connect the electro-mechanical transducers to the driving circuit member. A voltage applied to the electro-mechanical transducers through the wire members deforms the electro-mechanical transducers and the diaphragms to generate pressure in the liquid chambers.

10 Claims, 7 Drawing Sheets

LIQUID-DROPLET EJECTION HEAD AND LIQUID-DROPLET EJECTION APPARATUS INCLUDING SAME

CROSS-REFERENCE TO RELATED APPLICATIONS

The present patent application claims priority pursuant to 35 U.S.C. §119 from Japanese Patent Application No. 2009-267304, filed on Nov. 25, 2009 in the Japan Patent Office, which is incorporated herein by reference in its entirety.

BACKGROUND OF THE DISCLOSURE

1. Field of the Disclosure

Exemplary embodiments of the present disclosure relate to a liquid-droplet ejection head and a liquid-droplet ejection apparatus including the liquid-droplet ejection head, and more specifically to an inkjet head and an inkjet recording apparatus including the inkjet head.

2. Description of the Background

As one type of liquid ejection apparatus including a liquid ejection head, inkjet printers including inkjet heads are widely used because of their excellent image quality, low print cost, and wide product range from high-speed and high-priced printers to low-speed and low-priced printers. For such inkjet printers, there is strong market demand for even better image quality, cost reduction, and downsizing.

As a method of manufacturing an inkjet head, for example, micro-electro-mechanical systems (MEMS) technology is widely used. The MEMS technology is a fine processing technology involving semiconductor processing. For example, components of an inkjet head, such as a liquid chamber, a diaphragm, a piezoelectric element, and an electrode, are formed on a silicon substrate by etching, sputtering, or other processing. By reducing the sizes of those components or creating a better arrangement, the inkjet heads can be downsized. As a result, an increased number of heads can be produced from a single sheet of the silicon substrate. That is, as the size of the inkjet head is reduced, the production cost of the inkjet head is also reduced.

For downsizing of the inkjet head, one important challenge is to mount a driving integrated circuit (IC) for driving a piezoelectric element in the inkjet head in a more compact manner.

FIG. 1 is a schematic view of a configuration of a conventional type of inkjet head. As illustrated in FIG. 1, the conventional type of inkjet head has a head assembly 200 that includes a nozzle substrate 201 having nozzle orifices therein through which ink droplets are ejected, a chamber substrate 202 including liquid chambers to which ink is supplied under pressure generated by deformation of diaphragms with piezoelectric elements, a liquid supply substrate 203 having liquid supply passages therein through which ink is supplied to the liquid chambers, and a frame substrate 204. Further, a flexible printed circuit (FPC) 206 is electrically connected to the head assembly 200 by soldering or anisotropic conductive film (ACF) bonding, and driving integrated circuits (ICs) 205 for driving the piezoelectric elements of the chamber substrate 202 are bonded on the FPC 206.

In such a configuration, the FPC 206 may be shaken by the movement of the head and the bonding strength of the FPC 206 with the head assembly 200 may be weakened. Further, the above-described configuration takes up relatively much space, preventing downsizing.

To cope with such challenges, conventional techniques have been proposed that mount the driving ICs in a head assembly. For example, JP-2005-349712-A describes a configuration in which driving ICs are bonded on a piezoelectric-element substrate including piezoelectric elements.

In such a configuration, however, pressure chambers (substantially parallel to the diaphragms and piezoelectric elements) are arranged in series with ink channels and the driving ICs. Consequently, the total width of the inkjet head including the widths of those components is increased and relatively large.

By contrast, in conventional types of inkjet heads like those described in JP-3988042-B and JP-3580363-B, liquid chambers are arranged parallel to the driving ICs. Specifically, in JP-3988042-B, a sealing substrate is provided at the piezoelectric-element side of a channel formation substrate on which piezoelectric elements are formed, and the driving ICs are bonded on the sealing substrate. Alternatively, JP-3580363-B describes a configuration in which wire members for wire bonding extend outward from the driving ICs. Such a configuration can reduce the width of the channel formation substrate including liquid chambers.

However, for the above-described configurations, the sealing substrate or reservoir formation substrate on which driving ICs are mounted has a width including the widths of the driving ICs and reservoirs or the widths of piezoelectric elements and reservoirs. To suppress cross talk, the reservoir preferably has a large capacity, in particular, a capacity sufficient to reliably supply a certain maximum amount of ink flowing to the respective liquid chambers when ink droplets are simultaneously ejected from all channels. As the supply amount of ink decreases, the drive frequency is forced lower, significantly affecting ejection characteristics of the inkjet head. If the width of the reservoir is increased in consideration of such factors, the total width of the inkjet head is not reduced, resulting in increased cost.

SUMMARY

In an aspect of this disclosure, there is provided an improved liquid-droplet ejection head including a nozzle substrate, a chamber substrate, a liquid supply substrate, a frame substrate, a driving circuit member, and wire members. The nozzle substrate includes a plurality of nozzles. The chamber substrate is formed on the nozzle substrate and includes a plurality of liquid chambers connected to the respective nozzles, a plurality of diaphragms forming part of the plurality of liquid chambers, and a plurality of electro-mechanical transducers mounted on the diaphragms corresponding to the plurality of liquid chambers. The liquid supply substrate is formed on the chamber substrate and includes a plurality of liquid supply channels through which liquid is supplied to the plurality of liquid chambers in the chamber substrate. The frame substrate is formed on a first face of the liquid supply substrate opposite a second face of the liquid supply substrate formed on the chamber substrate. The driving circuit member that drives the plurality of electro-mechanical transducers is mounted on the frame substrate. The plurality of wire members connects the plurality of electro-mechanical transducers to the driving circuit member. A voltage applied to the electro-mechanical transducers through the plurality of wire members deforms the electro-mechanical transducers and the diaphragms to generate pressure in the liquid chambers.

In an aspect of this disclosure, there is provided an improved liquid-droplet ejection apparatus including a liquid-droplet ejection head. The liquid-droplet ejection head includes a nozzle substrate, a chamber substrate, a liquid supply substrate, a frame substrate, a driving circuit member, and wire members. The nozzle substrate includes a plurality of nozzles. The chamber substrate is formed on the nozzle substrate and includes a plurality of liquid chambers connected to the respective nozzles, a plurality of diaphragms forming part of the plurality of liquid chambers, and a plurality of electro-mechanical transducers mounted on the diaphragms corresponding to the plurality of liquid chambers. The liquid supply substrate is formed on the chamber substrate and includes a plurality of liquid supply channels through which liquid is supplied to the plurality of liquid chambers in the chamber substrate. The frame substrate is formed on a first face of the liquid supply substrate opposite a second face of the liquid supply substrate formed on the chamber substrate. The driving circuit member that drives the plurality of electro-mechanical transducers is mounted on the frame substrate. The plurality of wire members connects the plurality of electro-mechanical transducers to the driving circuit member. A voltage applied to the electro-mechanical transducers through the plurality of wire members deforms the electro-mechanical transducers and the diaphragms to generate pressure in the liquid chambers.

BRIEF DESCRIPTION OF THE DRAWINGS

Additional aspects, features, and advantages of the present disclosure will be readily ascertained as the same becomes better understood by reference to the following detailed description when considered in connection with the accompanying drawings, wherein.

Figure 1:
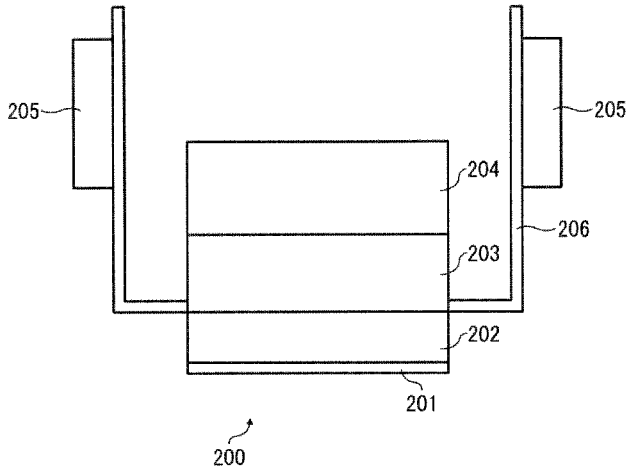
FIG. 1 is a schematic view of a configuration of a conventional type of inkjet head.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Figure 2:
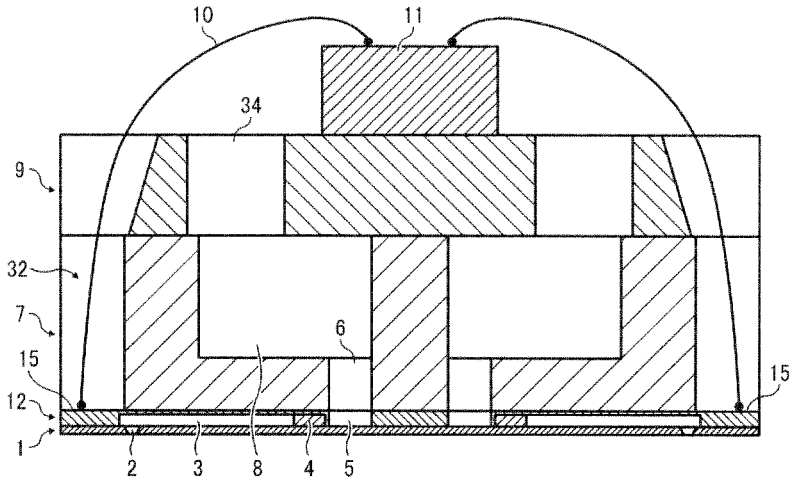
FIG. 2 is a schematic view of a configuration of an inkjet head according to a first exemplary embodiment.
Figure 3:
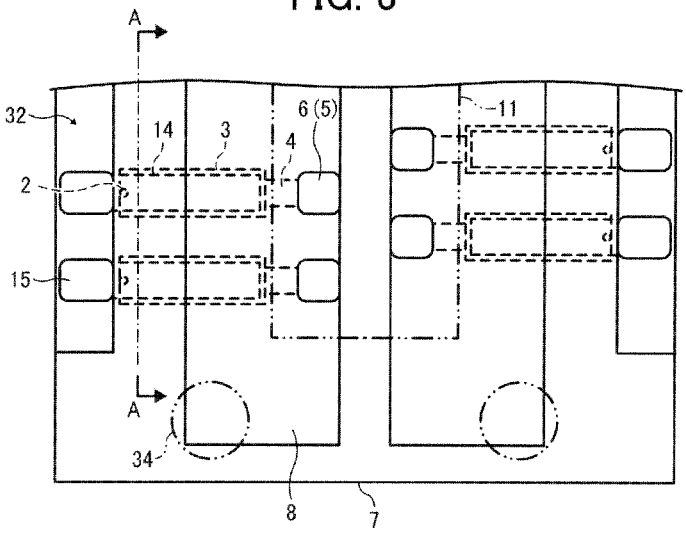
FIG. 3 is a schematic transparent view of the inkjet head illustrated in FIG. 2.
Figure 4:
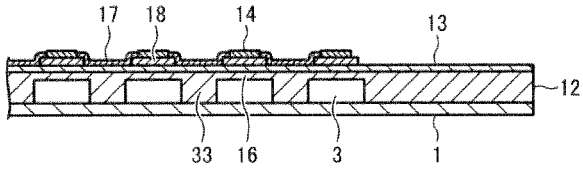
FIG. 4 is a cross sectional view of the inkjet head cut along a line A-A illustrated in FIG. 3.

Referring now to the drawings, wherein like reference numerals designate identical or corresponding parts throughout the several views, in particular to FIGS. 2 to 4, a liquid ejection head according to an exemplary embodiment of the present disclosure is described taking an example of an inkjet head.

FIG. 2 is a schematic configuration view of an inkjet head according to a first exemplary embodiment of the present disclosure. FIG. 3 is a schematic transparent view of the inkjet head illustrated in FIG. 2. FIG. 4 is a cross sectional view of the inkjet head cut along a line A-A illustrated in FIG. 3 and shows a configuration of the vicinity of a piezoelectric element and a liquid chamber.

As illustrated in FIG. 2, the inkjet head according to the present exemplary embodiment includes a nozzle substrate 1 including a plurality of nozzles 2, a plurality of liquid chambers 3 connected to the corresponding nozzles 2, a chamber substrate 12 in which the liquid chambers 3 are formed, a liquid supply substrate 7 including common chambers 8 from which ink is supplied to the liquid chambers 3 via ink supply channels 6, and a frame substrate 9 including ink inlet passages 34 through which ink is supplied from external ink tanks to the common chambers 8. The nozzle substrate 1, the chamber substrate 12, the liquid supply substrate 7, and the frame substrate 9 are sequentially layered one on top of the other in this order. That is, the frame substrate 9 is bonded on the liquid supply substrate 7, and the liquid supply substrate 7 is bonded on the chamber substrate 12. The chamber substrate 12 is bonded on the nozzle substrate 1. In other words, the frame substrate 9 is bonded on a first (upper) face of the liquid supply substrate 7 opposite a second (lower) face of the liquid supply substrate 7 that is bonded on the chamber substrate 12.

The chamber substrate 12 includes fluid resistance portions 4 and ink-introducing passages 5 connected to the ink supply channels 6 of the liquid supply substrate 7.

As illustrated in FIG. 4, the chamber substrate 12 further includes diaphragms 16 constituting part of the liquid chambers 3 and electro-mechanical transducers, which in this case are piezoelectric elements 18. The liquid chambers 3 are separated from each other by partitions 33.

As illustrated in FIG. 2, in the present exemplary embodiment, a driving integrated circuit member (hereinafter, "driving IC") 11 is formed directly on the frame substrate 9. The driving IC 11 and the piezoelectric elements 18 are connected by wire members 10, and a voltage is applied to each of the piezoelectric elements 18 via the wire members 10 to generate pressure in the liquid chambers 3.

More specifically, in accordance with image signals inputted to the driving IC 11, a voltage is applied to each of the piezoelectric elements 18 to deform the corresponding diaphragm 16 integrated with the piezoelectric element 18. Deformation of the diaphragms 16 generates pressure on ink filling the liquid chambers 3 to forcibly eject ink droplets from the nozzles 2 onto a recording sheet to form an image on the recording sheet Next, a process of making the inkjet head according to the present exemplary embodiment is described with reference to FIGS. 2 to 4.

The chamber substrate 12 is a silicon substrate. A plurality of lower electrodes 13 is formed on one face of the chamber substrate 12 by, e.g., sputtering, and the piezoelectric elements 18 are formed on the corresponding lower electrodes 13. The piezoelectric elements 18 are patterned with predetermined lengths and widths. An insulation layer 17 is formed at an appropriate area on the lower electrodes 13 and the piezoelectric elements 18, and upper electrodes 14 are formed on the piezoelectric elements 18. Pads 15 made of, for example, gold are formed on electrode pick-up portions of the upper electrodes 14 (see FIGS. 2 and 3).

To the chamber substrate 12 is bonded the liquid supply substrate 7, which is, for example, a glass or silicon substrate. As illustrated in FIG. 3, cut portions 32 are formed in advance by etching the liquid supply substrate 7 to expose the ink supply channels 6, the common chambers 8, and the pads 15 on the chamber substrate 12.

The chamber substrate 12 is processed and ground to a predetermined thickness. In the present exemplary embodiment, the thickness of the chamber substrate 12 is preferably not more than 100 μm.

Then, the ink-introducing passages 5 are formed by, for example, etching to serve as openings connected to the liquid chambers 3, the fluid resistance portions 4, and the common chambers 8. As illustrated in FIG. 3, the fluid resistance portions 4 are formed to a width smaller than a width of the liquid chamber 3 to generate fluid resistance.

The nozzle substrate 1 is bonded to the chamber substrate 12, and the frame substrate 9 is bonded on the first face of the liquid supply substrate 7 opposite the second face of the liquid supply substrate 7 on which the chamber substrate 12 is bonded. In the frame substrate 9, at least one ink inlet passage 34 is formed for each row in which the liquid chambers 3 are arrayed.

The driving IC 11 is bonded on the frame substrate 9, and connected to the pads 15 via the wire members 10 by wire bonding. It is to be noted that the connecting or wire bonding between the nozzle substrate 1, the frame substrate 9, and the driving IC 11 may be performed in any other suitable order.

On the frame substrate 9, electrodes are patterned at positions corresponding to terminals of the driving IC 11, thus allowing input of signals and power via wire members.

The bonding of the driving IC 11 to the frame substrate is preferably performed by wire bonding to shorten the length (width) of the bonded area. Wire bonding is also preferable in that the bonding temperature is relatively low. Further, as illustrated in FIG. 2, wire bonding is preferable in a case in which bonding targets (wired portions) are different in height.

As described above, the liquid supply substrate 7 may be a silicon substrate. Alternatively, the liquid supply substrate 7 may be made of glass and processed by, for example, sandblasting, thus allowing further cost reduction.

Although the frame substrate 9 may be made of glass, preferably the frame substrate 9 is made of resin to achieve further cost reduction. However, since high temperatures are involved in bonding the driving IC 11, the frame substrate 9 is more preferably made of, in particular, liquid crystal polymer, polyphenylene sulfide (PPS) resin, epoxy resin, or other heat-resistant resin.

Next, an inkjet head according to a second exemplary embodiment is described below. In the following description, the same reference characters are allocated to components and members corresponding to those described above and redundant descriptions thereof are omitted below.

Figure 5:
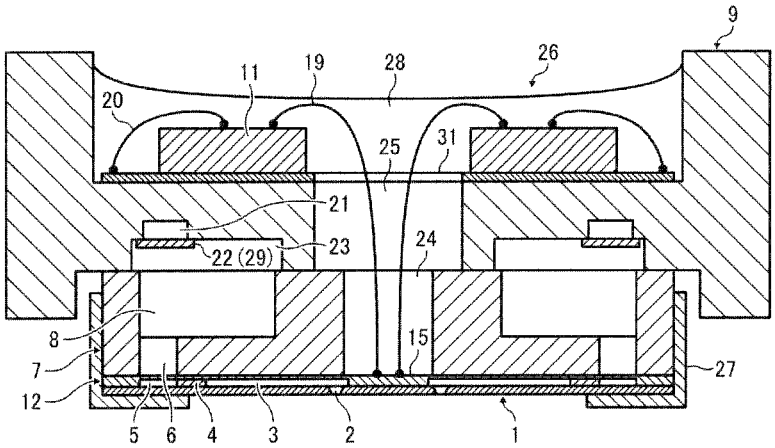
FIG. 5 is a schematic view of a configuration of the inkjet head according to a second exemplary embodiment.
Figure 6:
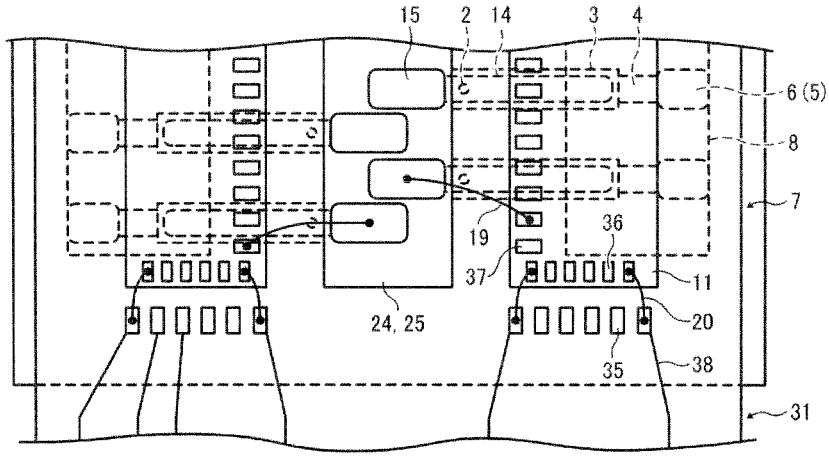
FIG. 6 is a schematic transparent view of the inkjet head illustrated in FIG. 5.

FIG. 5 is a schematic view of a configuration of the inkjet head according to the second exemplary embodiment. FIG. 6 is a schematic transparent view of the inkjet head illustrated in FIG. 5.

The inkjet head illustrated in FIG. 5 differs from the inkjet head illustrated in FIG. 2 in that openings 24 and 25 are provided in a middle portion of each of a liquid supply substrate 7 and a frame substrate 9 to connect driving ICs 11 to piezoelectric elements 18 and formed in a chamber substrate 12. The driving ICs 11 are connected to the pads 15 at a middle portion of the chamber substrate 12 by wire bonding. As a result, in FIG. 5, the arrangement of liquid chambers 3, fluid resistance portions 4, ink-introducing passages 5, and ink supply channels 6 is opposite to the arrangement of those components in FIG. 2.

The plurality of driving ICs 11 is provided for piezoelectric elements 18 corresponding to the liquid chambers 3 via the opening 25 of the frame substrate 9, and the pads 15 are connected to the driving ICs 11.

Nozzle covers 27 are bonded to outer edge portions of the nozzle substrate 1, the chamber substrate 12, and the liquid supply substrate 7. The configuration around the piezoelectric elements 18 and the liquid chambers 3 is similar to that shown in FIGS. 2 and 4.

As illustrated in FIG. 2, in a case in which the bonding pads are provided at the outer sides of the inkjet head, the width of two pads is added to the width of the inkjet head. By contrast, as illustrated in FIG. 5, in a case in which the bonding pads are provided at the middle portion of the inkjet head, the width of the bonding pads added to the total width of the inkjet head is less than the width of two pads, thus achieving a reduced width of the inkjet head.

The configuration of the inkjet head according to the present exemplary embodiment is further described below.

As illustrated in FIG. 5, the opening 24 is provided in the middle portion of the liquid supply substrate 7, and the pads 15 are provided at extensions of upper electrodes 14 (see FIG. 4) on the piezoelectric elements 18 that are integrally formed with the chamber substrate 12. The opening 25 is provided in the middle portion of the frame substrate 9 bonded to the liquid supply substrate 7.

Second common chambers 23 are provided on a bonded face of the frame substrate 9 with the liquid supply substrate 7, and serve as common chambers of the inkjet head along with the common chambers 8 of the liquid supply substrate 7.

A recessed portion 26 is formed in a side of the frame substrate 9 opposite the bonded face of the frame substrate 9 with the liquid supply substrate 7. At a bottom face of the recessed portion 26 is provided a flexible printed circuit (FPC) 31 on which the driving ICs 11 are bonded.

Another opening corresponding to the opening 25 is provided in the FPC 31, thus allowing the driving ICs 11 to be connected to the pads 15 at the middle portion of the chamber substrate 12 by wire bonding.

As illustrated in FIG. 6, the driving ICs 11 are bonded on the FPC 31, and pads 36 are formed on the FPC 31 by, e.g., gold coating. Further, pads 36 and 37 are formed on the driving ICs 11. The pads 36 and 37 are connected to the pads 35 and 15 via wire members 20 and 19, respectively, by wire bonding. Through proper connecting, power and signals are inputted to the pads 35 via wire members 38 formed on the FPC 31.

As described above, in FIG. 5, instead of directly bonding the driving ICs 11 on the frame substrate 9, the driving ICs 11 is bonded on the FPC 31 that is provided on the frame substrate 9, thus allowing cost reduction. This is because, if the driving ICs are bonded directly on the frame substrate, it would be necessary to form electrodes and bonding bumps on the frame substrate in addition to a similar FPC to connect the electrodes from the frame substrate to the outside.

Further, for the configuration illustrated in FIG. 5, the bonded face of the frame substrate 9 with the liquid supply substrate 7 constitutes part of a surface of each common chamber 8, thus reducing the total width of the inkjet head.

The above-described configuration allows reduction of the size of the liquid supply substrate 7 manufactured by a fine processing technique. By contrast, in order to suppress cross talk in the inkjet head and to secure the supply amount of ink, the capacity of the common chambers 8 is preferably large.

Typically, for cross talk, a diaphragm is provided to buffer a transmitted pressure. In the present exemplary embodiment, as illustrated in FIG. 5, a space (concave portion) 21 is provided at one face of each of the second common chambers 23 in the frame substrate 9, and a thin plate 22 of stainless steel (SUS) is bonded to seal the space 21. The thin plate 22 is a diaphragm serving as a buffer member 29 for a pressure wave transmitted through liquid, thereby reducing cross talk.

Next, an inkjet head according to a third exemplary embodiment is described below.

Figure 7:
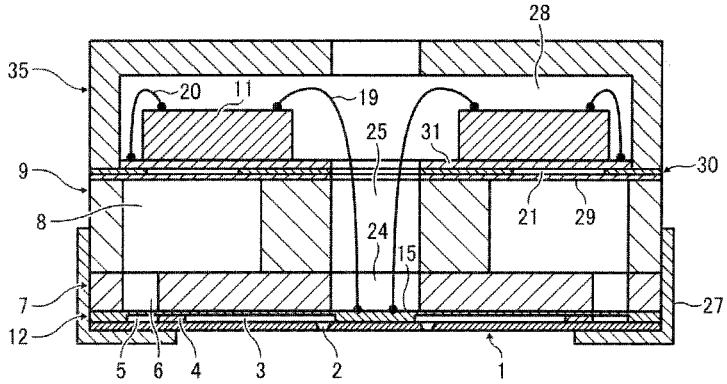
FIG. 7 is a schematic view of a configuration of the inkjet head according to a third exemplary embodiment.

FIG. 7 is a schematic view of a configuration of the inkjet head according to the third exemplary embodiment. The inkjet head illustrated in FIG. 7 has a modified configuration of the inkjet head illustrated in FIG. 5. The inkjet head illustrated in FIG. 7 differs from the inkjet head illustrated in FIG. 5 in that a frame substrate 9 constituting partitions of common chambers 8 is bonded on an upper face of a liquid supply substrate 7 and a buffer member 29 is bonded on an upper face of the frame substrate 9.

A thin-plate frame substrate 30 is bonded on the buffer member 29, and an opening 21 is formed at a part of the thin-plate frame substrate 30, thus facilitating absorption of a pressure wave transmitted through liquid. A FPC 31 is provided on an upper face of the thin-plate frame substrate 30, and driving ICs 11 are bonded on the FPC 31. Further, a protection frame 35 for protecting the driving ICs 11 is bonded on the thin-plate frame substrate 30.

To connect the driving ICs 11 to the piezoelectric elements 18 provided at the chamber substrate 12, an opening 24 is provided so as to pass through the liquid supply substrate 7 and an opening 25 is provided so as to pass through the frame substrate 9, the buffer member 29, the thin-plate frame substrate 30, and the FPC 31.

In FIG. 7, the plurality of driving ICs 11 is provided for the piezoelectric elements 18 corresponding the respective liquid chambers 3, and pads 15 are connected to the corresponding driving ICs 11.

As illustrated in FIG. 2, in a case in which the bonding pads are provided at outer sides of the inkjet head, the double width of the bonding pad is added to the total width of the inkjet head. By contrast, as illustrated in FIG. 7, in a case in which the pads 15 are provided at a middle portion of the inkjet head, the pads 15 can be arranged so that the width of the pads 15 added to the total width of the inkjet head is less than the double width of the pad 15.

For the inkjet head illustrated in FIG. 7, the openings 24 and 25 are formed to install wire members at the middle portion of the inkjet head, and bonding boards to which the liquid supply substrate 7 and the frame substrate 9 are bonded are formed. Further, the driving ICs 11, which may occupy a relatively large space, are mounted on the thin-plate frame substrate 30, which can be manufactured at low cost by press working, thereby allowing significantly reducing the size of the liquid supply substrate 7 manufactured by fine processing.

In addition, the liquid chambers 3, the common chambers 8, and the driving ICs 11, which have relatively large sizes in the horizontal direction in FIG. 7, are not serially arranged or formed but distributed in multiple layers. Such a configuration can significantly reduce the size of the inkjet head in the horizontal direction, increase the number of chips made on a silicone substrate, and reduce the manufacturing cost per unit.

Further, in the present exemplary embodiment, the buffer member 29, the thin-plate frame substrate 30, the FPC 31, and the driving ICs 11 are layered on the common chambers 8. Such a configuration can achieve cooling effect of absorbing heat of the driving ICs 11 by ink filled in the common chambers 8.

As a method of reducing cross talk, for example, the volume of the common chamber 8 or the area of the buffer member 29 may be enlarged. For the present exemplary embodiment, the buffer member 29 that buffers transmitted pressure to reduce cross talk is provided over the entire upper face of the frame substrate 9 so that a relatively large size of pressure buffering section can be formed even if the width of the inkjet head is minimized.

In addition, the opening 21 having a relatively large area is provided at a portion of the thin-plate frame substrate 30 to increase a movable area of the buffer member 29. Further, the thin-plate frame substrate 30 forming the pressure buffering section along with the buffer member 29 is provided on the upper face of the frame substrate 9 including the common chambers 8, thereby reducing cross talk.

In FIG. 7, nozzle covers 27 are provided at outer end portions of the nozzle substrate 1, the chamber substrate 12, and the liquid supply substrate 7.

Figure 8A:
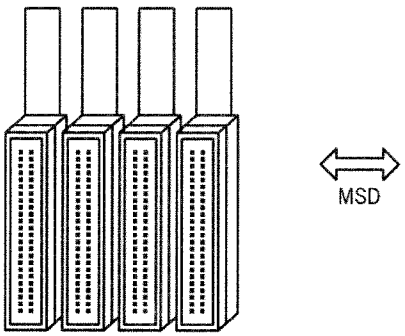
FIGS. 8A and 8B are schematic views of examples of ways in which inkjet heads according to exemplary embodiments are mounted in a liquid ejection apparatus.
Figure 8B:
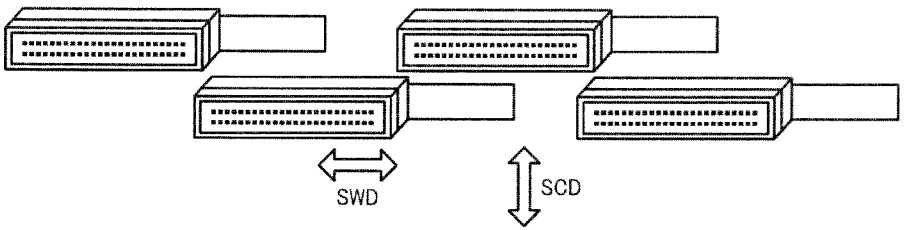

FIGS. 8A and 8B show examples of ways in which the inkjet heads according to an exemplary embodiment of the present disclosure is mounted in a printer which is an example of liquid ejection apparatus.

In a case in which the inkjet head is mounted in a serial-type printer, as illustrated in FIG. 8A, for example, four inkjet heads separately filled with cyan, magenta, yellow, and black inks are arranged on a carriage in such a manner that the long direction of each head is perpendicular to a main scan direction (MSD) of the carriage. As a recording sheet is conveyed in a sheet conveyance direction (SCD) (also referred to as sub-scanning direction), the carriage with the inkjet heads moves in the main scan direction. In this time, the inkjet heads eject ink droplets onto the recording sheet in accordance with image signals to form a desired image on the recording sheet.

Typically, the size of the serial-type printer in the lateral direction is twice the width obtained by adding the width of sheet to the width of the head unit (including four heads). Accordingly, the size of the serial-type printer in the lateral direction is one important factor for downsizing of such a serial-type printer. Thus, the inkjet head according to any of the above-described exemplary embodiment of the present disclosure allows production of a more compact size of serial-type printer.

In addition to the serial-type printer, as illustrated in FIG. 8B, a plurality of inkjet heads according to any of the above-described exemplary embodiment may be arranged so as to form a line head unit in which the long direction of each head is parallel to a sheet width direction (SWD), i.e., a direction perpendicular to the sheet conveyance direction (SCD). The inkjet head according to any of the above-described exemplary embodiment can achieve the arrangement of the line-head unit having a relatively small width in a direction perpendicular to the sheet width direction. Accordingly, for example, in a case in which the line head unit is configured to eject four color inks, the width of the head unit is quite small, thus allowing downsizing and cost reduction.

Figure 9:
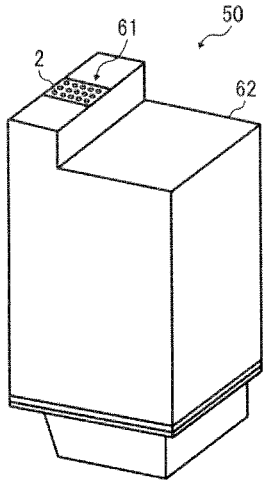
FIG. 9 is a schematic perspective view of an ink cartridge according to an exemplary embodiment.

FIG. 9 is a schematic perspective view of an ink cartridge 50 including an inkjet head 61 according to an exemplary embodiment of the present disclosure.

The ink cartridge 50 is described below with reference to FIG. 9. For the ink cartridge 50, the inkjet head 61 according to any of the above-described exemplary embodiments including nozzles 2 and other components is integrally formed as a single unit with an ink tank 62. The ink cartridge 50 is mountable in, for example, the serial-type printer described with reference to FIG. 8A. For such an inkjet head integrated with an ink tank, cost reduction and enhanced reliability of the head leads to cost reduction and enhanced reliability of the entire ink cartridge.

As described above, cost reduction, enhanced reliability, and reduction of production errors achieved by the inkjet head according to any of the above-described exemplary embodiment can increase the yield and reliability of the head-integrated ink cartridge, thereby reducing the production cost of the entire cartridge.

Figure 10:
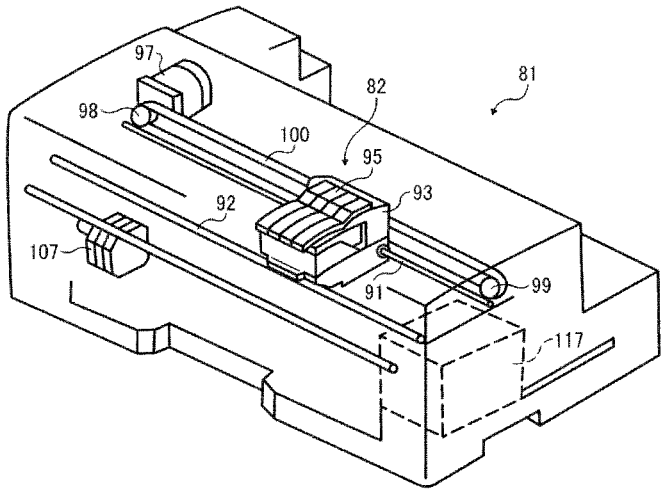
FIG. 10 is a perspective view of an inkjet recording apparatus as an example of a liquid ejection apparatus.
Figure 11:
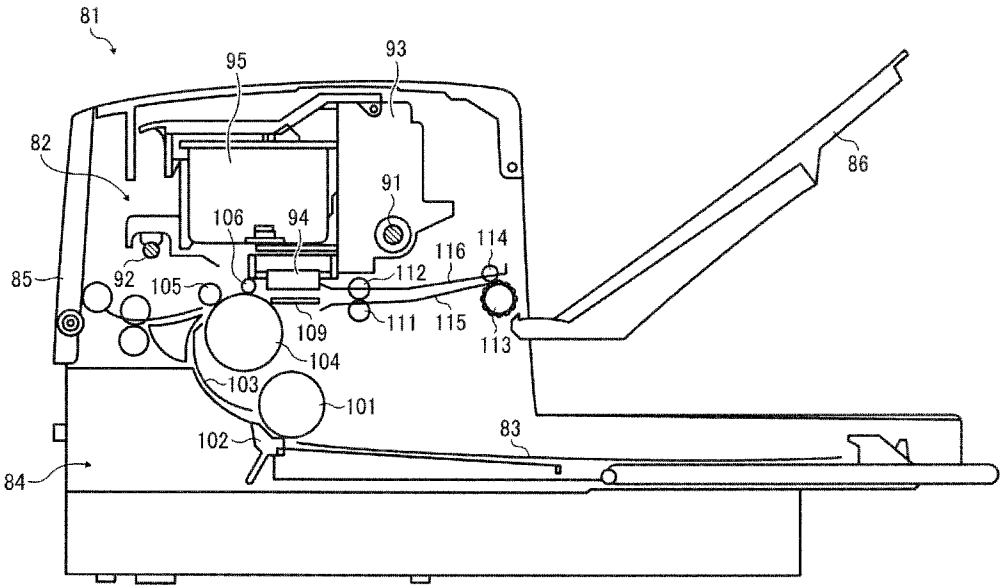
FIG. 11 is a side view of a mechanical section of the inkjet recording apparatus illustrated in FIG. 10.

FIG. 10 is a perspective view of an inkjet recording apparatus 81 which is a liquid ejection apparatus according to an exemplary embodiment of the present disclosure. FIG. 11 is a side view of a mechanical section of the inkjet recording apparatus 81 illustrated in FIG. 10. Below, the inkjet recording apparatus 81 is described as a liquid ejection apparatus including an inkjet head according to one of the above-described exemplary embodiments with reference to FIGS. 10 and 11.

The inkjet recording apparatus 81 illustrated in FIGS. 10 and 11 includes a print section 82. The print section 82 includes a carriage 93 movable in a main scan direction, recording heads 94 that are liquid-droplet ejection heads (inkjet heads) according to one of the above-described exemplary embodiments, and ink cartridges 95 that supply ink to the recording heads 94.

At a front lower portion of the inkjet recording apparatus 81, a sheet feed cassette (or sheet feed tray) in which a large number of sheets 83 can be loaded from the front side of the inkjet recording apparatus 81 is removably insertable in the inkjet recording apparatus 81. A manual feed tray 85 for manually feeding sheets is pivotably mounted at the front side of the inkjet recording apparatus 81. Receiving a sheet 83 from the sheet feed cassette 84 or the manual feed tray 85, the print section 82 records (forms) an image on the sheet 83 and outputs the sheet 83 to an output tray 86 mounted at the rear side of the inkjet recording apparatus 81.

In the print section 82, the carriage 93 is supported by a main guide rod 91 and a sub guide rod 92 serving as guide members so as to slide in the main scan direction. The main guide rod 91 and the sub guide rod 92 are laterally extended between side plates.

On the carriage 93 are mounted the recording heads 94, which are the inkjet heads according to one of the above-described exemplary embodiments, to eject ink droplets of different colors, e.g., yellow (Y), cyan (C), magenta (M), and black (Bk). For the recording heads 94, a plurality of nozzle orifices (ink ejection ports) is arranged in a direction perpendicular to the main scan direction so as to eject ink droplets downward. The ink cartridges 95 that supply the different color inks to the corresponding recording heads 94 are replaceably mounted on the carriage 93.

Each of the ink cartridges 95 has an air release port opened to the atmosphere at an upper portion thereof, a supply port through which ink is supplied to each recording head 94 at a lower portion thereof, and a porous member therein to be filled with ink. Ink supplied to the ink cartridge 95 is kept at a slight negative pressure by a capillary force of the porous member. In the present exemplary embodiment, the recording heads 94 are described as a plurality of recording heads for ejecting different color inks. However, it is to be noted that one recording head may be used to eject droplets of different color inks through separate rows of the nozzle orifices.

The main guide rod 91 is inserted through a rear portion (at the downstream side in the sheet conveyance direction) of the carriage 93 so that the carriage 93 slides on the main guide rod 91. Meanwhile, a front portion (at the upstream side in the sheet conveyance direction) of the carriage 93 is slidably mounted on the sub guide rod 92.

To move the carriage 93 for scanning in the main scan direction, a timing belt 100 is extended with tension between a driving pulley 98, which is driven by a main scan motor 97, and a driven pulley 99. The carriage 93 is fixed on the timing belt 100 and reciprocally moved via the timing belt 100 in accordance with forward and reverse rotation of the main scan motor 97.

To feed sheets 83 from the sheet feed cassette 84 below the recording heads 94, the inkjet recording apparatus 81 includes a sheet feed roller 101 and a friction pad 102 to separately feed the sheets 83 from the sheet feed cassette 84, a guide member 103 to guide the sheet 83, a conveyance roller 104 to convey the sheet 83 while turning around the conveyance direction of the sheet 83, a press roller 105 pressed against the surface of the conveyance roller 104, and a front-end regulation roller 106 to regulate an angle at which the sheet 83 is fed from the conveyance roller 104. The conveyance roller 104 is driven by a sub-scan motor 107 via a gear train.

The inkjet recording apparatus 81 also includes a print receiver 109 serving as a sheet guide member that guides the sheet 83 from the conveyance roller 104 below the recording heads 94 within a moving range of the carriage 93 in the main scan direction.

At the downstream side of the print receiver 109 in the sheet conveyance direction are disposed a transport roller 111 and a first spur 112 that are rotated to feed the sheet 83 in the sheet output direction, a sheet output roller 113 and a second spur 114 that feed the sheet 83 to the output tray 86, and guide members 115 and 116 forming a sheet output passage.

During image recording, the inkjet recording apparatus 81 drives the recording heads 94 in accordance with image signals while moving the carriage 93 to eject ink droplets onto the sheet 83 stopped below the recording heads 94. Thus, one band of the desired image is recorded on the sheet 83, and after the sheet 83 is fed by a predetermined distance, another band of the image is recorded. Receiving a recording end signal or a signal indicating that the rear end of the sheet 83 has reached the recording area of the recording heads 94, the recording operation is finished and the sheet 83 is outputted to the output tray 86.

At a position outside the recording area at one end in the moving direction of the carriage 93 is disposed a recovery device 117 that eliminates an ejection failure of the recording heads 94. The recovery device 117 includes a cap unit, a suction unit, and a cleaning unit.

In a standby mode, the carriage 93 is positioned above the recovery device 117, and the recording heads 94 are capped with the cap unit to keep the moisture of nozzle orifices, thus preventing an ejection failure caused by dried ink. By discharging ink for maintenance during recording, the viscosity of ink in nozzle orifices is kept substantially constant, allowing a stable ejection performance.

If an ejection failure occurs, the cap unit seals the nozzle orifices of the recording heads 94 and the suction unit suctions bubbles as well as ink from the nozzle orifices. The cleaning unit removes ink or dust adhered at the nozzle faces of the recording heads 94, thus eliminating the ejection failure. The suctioned ink is drained to a waste ink container disposed at a lower portion of the inkjet recording apparatus 81 and absorbed in an ink absorber of the waste ink container.

As described above, the inkjet recording apparatus 81 includes the inkjet head according to any of the above-described exemplary embodiments. Such a configuration can prevent an ejection failure of ink droplets caused by a faulty driving of the diaphragm, obtain stable ejection properties, and improve image quality.

In the above-described exemplary embodiments, the liquid-droplet ejection head of the present disclosure is described as the inkjet head that ejects ink. However, it is to be noted that the liquid-droplet ejection head is not limited to the inkjet head and may be, for example, a liquid-droplet ejection head that ejects liquid resist, a liquid-droplet ejection head (spotter) that eject DNA samples, or any other suitable type of liquid-droplet ejection head.

Numerous additional modifications and variations are possible in light of the above teachings. It is therefore to be understood that within the scope of the appended claims, the present disclosure may be practiced otherwise than as specifically described herein.

With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

For example, elements and/or features of different exemplary embodiments may be combined with each other and/or substituted for each other within the scope of this disclosure and appended claims.

What is claimed is:

1. A liquid-droplet ejection head comprising:

a nozzle substrate comprising a plurality of nozzles;

a chamber substrate formed on the nozzle substrate and comprising a plurality of liquid chambers connected to the respective nozzles, a plurality of diaphragms forming part of the plurality of liquid chambers, and a plurality of electro-mechanical transducers mounted on the diaphragms corresponding to the plurality of liquid chambers;

a liquid supply substrate formed on the chamber substrate and comprising a plurality of liquid supply channels through which liquid is supplied to the plurality of liquid chambers in the chamber substrate;

a frame substrate formed on a first face of the liquid supply substrate opposite a second face of the liquid supply substrate formed on the chamber substrate;

a driving circuit member mounted on the frame substrate that drives the plurality of electro-mechanical transducers; and a plurality of wire members connecting the plurality of electro-mechanical transducers to the driving circuit member, wherein a voltage applied to the electro-mechanical transducers through the plurality of wire members deforms the electro-mechanical transducers and the diaphragms to generate pressure in the liquid chambers.

2. The liquid-droplet ejection head according to claim 1, further comprising:

a buffer member formed on the frame substrate; and a thin-plate frame member formed on the buffer member to reinforce the buffer member, wherein the driving circuit member is mounted on the thin-plate frame member.

3. The liquid-droplet ejection head according to claim 2, further comprising an opening in a middle portion of each of the liquid supply substrate, the frame substrate, the buffer member, and the thin-plate frame member, wherein the plurality of wire members connects the plurality of electro-mechanical transducers to the driving circuit member through the opening.

4. The liquid-droplet ejection head according to claim 2, further comprising a printed board intervening between the driving circuit member and the thin-plate frame member.

5. The liquid-droplet ejection head according to claim 4, wherein the thin-plate frame member is made of metal.

6. The liquid-droplet ejection head according to claim 1, further comprising an opening through a middle portion of each of the liquid supply substrate and the frame substrate, wherein the plurality of wire members connects the plurality of electro-mechanical transducers to the driving circuit member through the opening.

7. The liquid-droplet ejection head according to claim 1, further comprising:

a common chamber formed over both the liquid supply substrate and the frame substrate and connected to the plurality of liquid chambers, with a concave portion formed on a first face of the common chamber opposite a second face of the common chamber that faces the liquid supply channels of the liquid supply substrate; and a buffer member covering the concave portion to buffer transmission of pressure generated in the common chamber.

8. The liquid-droplet ejection head according to claim 1, wherein the liquid supply substrate is made of glass or silicon.

9. The liquid-droplet ejection head according to claim 1, wherein the frame substrate is made of resin.

10. The liquid-droplet ejection head according to claim 1, wherein the plurality of wire members connects the plurality of electro-mechanical transducers to the driving circuit member by wire bonding.

* * * * *